United States Patent [19]

Chang

[11] 4,155,030

[45] May 15, 1979

[54] MULTICOLOR DISPLAY DEVICE USING ELECTROLUMINESCENT PHOSPHOR SCREEN WITH INTERNAL MEMORY AND HIGH RESOLUTION

[75] Inventor: Ifay Chang, Mahopac, N.Y.

[73] Assignee: International Business Machines Corporation, Armonk, N.Y.

[21] Appl. No.: 861,597

[22] Filed: Dec. 19, 1977

[51] Int. Cl.[2] ..... H05B 37/00; H05B 39/00; H05B 41/00

[52] U.S. Cl. ..... 315/169.3; 340/704; 340/760; 340/781; 313/463; 313/494

[58] Field of Search ..... 313/463, 494, 498, 500, 313/503, 505, 506; 315/169 R, 169 TV; 340/166 EL, 324 M

[56] References Cited

U.S. PATENT DOCUMENTS

| | | | |
|---|---|---|---|
| Re. 24,540 | 9/1958 | Michlin | 313/498 |
| 3,388,277 | 6/1968 | Thornton | 313/503 X |
| 3,975,661 | 8/1976 | Kanatani et al. | 315/169 TV |
| 4,035,775 | 7/1977 | Chang | 340/32 M X |

*Primary Examiner*—Alfred E. Smith

*Assistant Examiner*—Robert E. Wise

*Attorney, Agent, or Firm*—Bernard N. Wiener

[57] ABSTRACT

The disclosure utilizes a memory electroluminescent (EL) layer which has brightness-voltage (B-V) characteristics with multistable hysteresis loops of one color emission. Another EL layer of second color emission is incorporated therewith for a multicolor display device. The device comprises the two EL layers fabricated in sandwich form separated from each and from the electrodes by insulating layers which are inserted for breakdown protection and isolation of the two EL layers. Certain insulating layers may be omitted if the two EL layers are made of compatible materials and the hysteresis characteristics are not effected. In steady operation, an AC voltage signal is applied to the sandwiched device to maintain a display characteristic. A superposed switching voltage or electron beam or light beam is used to trigger a desired display. The displayed image may be erased by reducing sustaining AC voltage below threshold value. The principle of this disclosure may be generalized to three or more layers so that greater flexibility of color choice is obtainable.

13 Claims, 8 Drawing Figures

MULTICOLOR DISPLAY DEVICE USING ELECTROLUMINESCENT PHOSPHOR SCREEN WITH INTERNAL MEMORY AND HIGH RESOLUTION

BACKGROUND OF THE INVENTION

Multicolor capability is an important function for display applications which can allow larger amount of high bit density information to be displayed more effectively than by switching on and off of one color. The existing color displays such as shadow mask cathode ray tubes (CRTs) and color gas panels typically trade resolution for color. This is not a very satisfactory trade for computer terminal displays which are generally used for viewing at close distance. An exception is the penetration CRT which, in principle, does not lose resolution while gaining color. However, this display has two serious problems, i.e., speed limitation (its high voltage switching is slow) and reliability (reliability of phosphor barrier layer is troublesome).

It is also desirable in high information content displays to have internal memory in addition to color capability. The combination of both memory and color are not easily achievable especially with high resolution. The present invention provides an electroluminescent display with both internal memory and multicolor capabilities with high resolution and beneficial addressing speed capability.

OBJECTS OF THE INVENTION

It is an object of this invention to provide an electroluminescent display device with multicolor capability.

It is another object of this invention to provide an electroluminescent display device with multicolor capability in an embodiment which is matrix addressed electrically.

It is another object of the invention to provide an electroluminescent display device with multicolor capability in an embodiment which is sensitized electrically and addressed by radiation.

It is another object of this invention to provide the preceeding embodiment with addressing either by electron beam radiation or laser beam radiation.

It is another object of this invention to provide an electroluminescent display device with both memory and multicolor capabilities.

SUMMARY OF THE INVENTION

This invention utilizes a memory electroluminescent (EL) layer which has brightness-voltage (B-V) characteristics with multistable hysteresis loops of one color emission. Another EL layer of second color emission is incorporated therewith for a multicolor display device. The device comprises the two EL layers fabricated in sandwich form separated from each and from the electrodes by insulating layers which are inserted for breakdown protection and isolation of the two EL layers. Certain insulating layers may be omitted of the two EL layers are made of compatible materials and the hysteresis characteristics are not affected. In steady operation, an AC voltage signal is applied to the sandwiched device to initiate a display characteristic. The applied alternating voltage may conveniently be a sequence of pulses. The principle of this invention may be generalized to three or more layers so that greater flexibility of color choice is obtainable.

The invention can be implemented in a matrix addressed mode, i.e., it is possible by two sets of orthogonal electrodes. Further, this invention can be implemented in a light beam or electron beam addressed mode because the B-V hysteresis of $EL_1$ can be triggered on by a light beam or by a electron beam or by a light beam addressed photoconductor. The $EL_1$ can be switched into a particular low impedance state proportional to the beam intensity, resulting in a particular brightness. In that state, the sustaining AC voltage excites both $EL_1$ and $EL_2$ and achieves a desired color emission.

Heretofore it has been technically difficult to achieve color capability without resolution reduction; and it has been more difficult to incorporate internal memory in a multicolor display. Practice of this invention provides a device which possesses memory, color and high resolution. The device fabrication may conveniently utilize conventional EL and insulator material technology.

BRIEF DESCRIPTION OF THE DRAWINGS

FIGS. 1A and 1B, and FIGS. 2A and 2B respectively exemplify light emission curves from two suitable electroluminescent materials for the practice of the invention wherein:

FIG. 1A is a set of brightness versus applied voltage hysteresis curves for one electroluminescent material for practice of this invention, and FIG. 1B, shows the characteristic intensity on a relative scale light emission from such a material ZnS doped with Mn (ZnS:Mn) indicating that the peak intensity is at approximably 5800 Angstroms, and FIG. 2A is the characteristic brightness versus voltage saturation curve for another electroluminescent material for practice of this invention, and FIG. 2B shows the characteristic intensity on a relative scale of light emission from such a material ZnS doped with Cu and Al (ZnS:Cu, Al).

FIGS. 5A and 5B are different illustrations showing aspects of another embodiment of this invention wherein a layered structure incorporating two different electroluminescent materials is sensitized electrically and addressed by radiation, wherein:

FIG. 5A shows the gross characteristics of the embodiment; and

FIG. 5B shows the layered structure.

PRACTICE OF THE INVENTION

The color mixture effect in accordance with the principles of the invention will be described first, and the sustaining AC voltage and addressing techniques to achieve embodiments with the multicolor and memory for the practice of this invention will be described next.

Figure 1A:
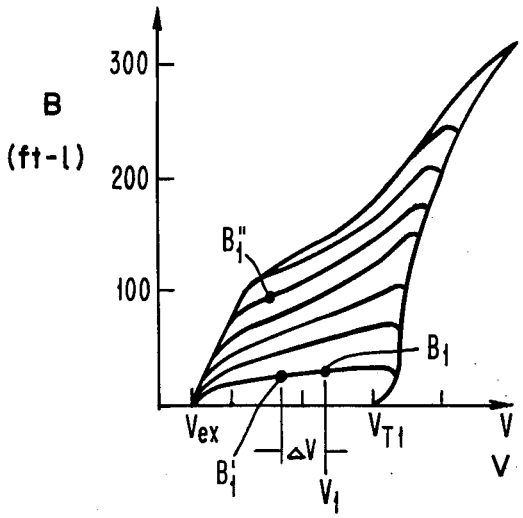
Figure 1B:
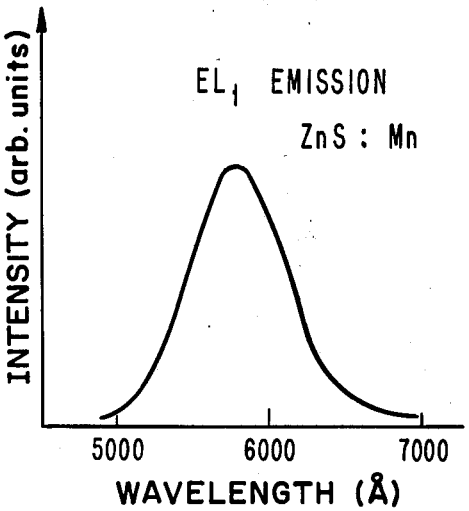
Figure 2A:
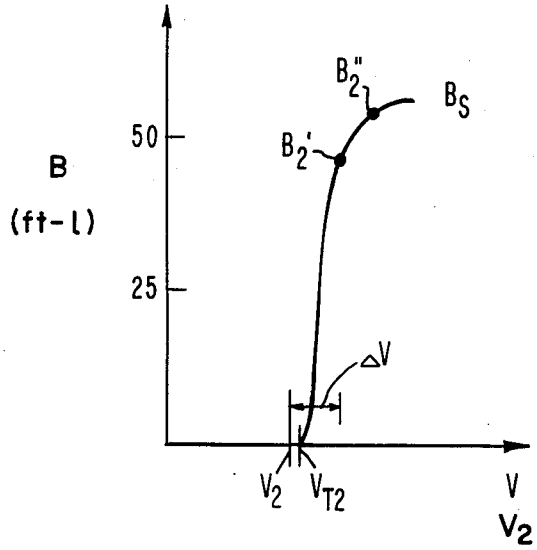
Figure 2B:
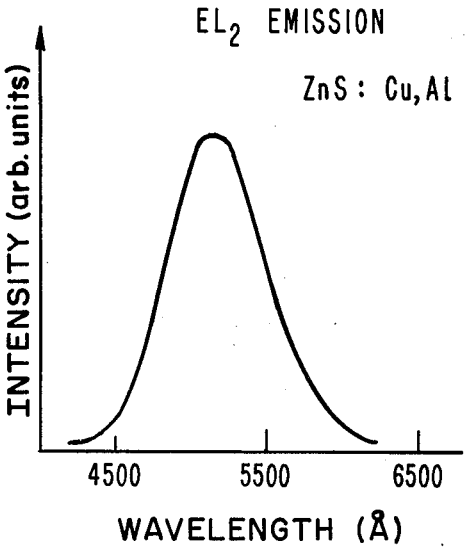
Figure 3:
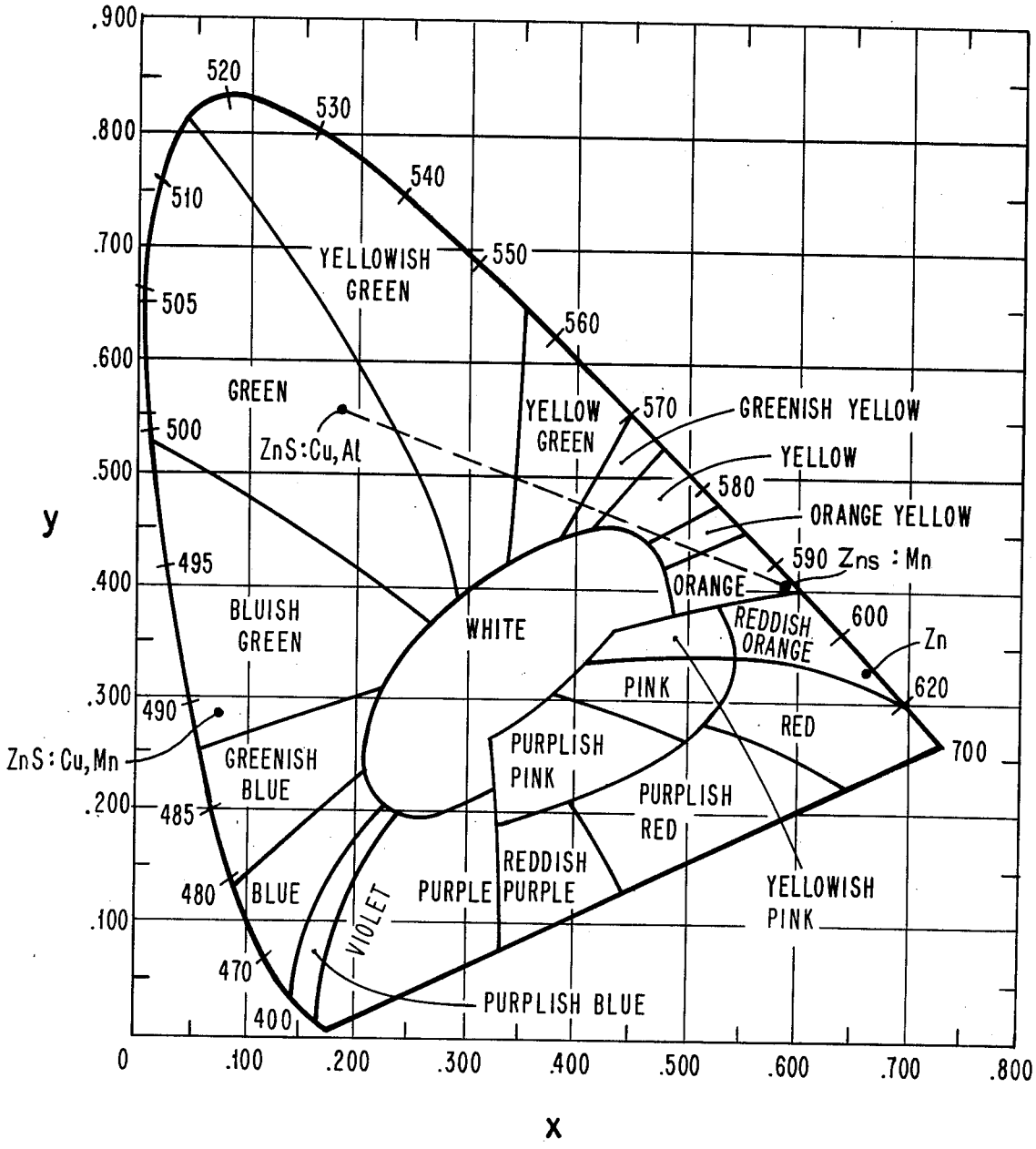
FIG. 3 is a representative Kelly chart showing color domains for various combinations of three primary light sources of red, green and blue, indicating the color capabilities for a display device in accordance with the principles of this invention incorporating ZnS:Mn and ZnS:Cu, Al materials.

The emission spectrum of one electroluminescent material ZnS:Mn $EL_1$-film as shown in FIG. 1B can be represented by the chromaticity parameter ($x=0.598, y=0.402$) which point is in the orange color zone of the Kelly chart of FIG. 3. A reference for the Kelly chart of FIG. 3, without the points for practice of this invention, if Proceedings of the Society for Information Display, Vol. 16, No. 1, First Quarter 1975, pp. 21–29. The emission spectrum of another electroluminescent material ZnS:Cu, Al $El_2$-film is shown in FIG. 2B can be represented by chromaticity parameters ($x=0.189, y=0.556$) which point is in the green color zone of the Kelly chart of FIG. 3. By combining the light emission spectra of these two materials there are colors obtained along the straight dashed line connecting the two indicated points for ZnS:Cu, Al and ZnS:Mn respectively. Thus, the resultant colors vary from orange, orange yellow, yellow, greenish yellow, yellow green, yellowish green to green.

The operation of a display device of this invention will be described with reference to FIG. 1A and FIG. 2A. The $EL_1$-film has a threshold voltage $V_T$, an extinction voltage $V_{ex}$ and a set of B-V hysteresis curves as shown in FIG. 1A. The $EL_2$-film has a threshold voltage $V_{T2}$ and has a steep B-V curve saturating at $B_S$ as shown in FIG. 2A. The threshold voltages are functions of EL-film thicknesses. In operation, a sustaining voltage $V_S=V_1+V_2$ is applied to the device where $V_1$ is the voltage on $EL_1$ and $V_2$ on $EL_2$. At these voltages $V_1<V_{T1}$, and $V_2<V_{T2}$, so neither of the EL layers produces light emission. As the voltage is increased by a switching increment $\Delta V_S$, this increment is initially shared by the two El layers. Due to this voltage increment, the $EL_1$ layer is excited to an "on" state at $B_1$ on the hysteresis curve and is maintained in a low impedance state having more current passing through it even when $\Delta V_S$ is removed.

When $\Delta V_S$ is removed the sustaining voltage is $V_S=V_1'+V_2'$, where $V_2'=V_2+\Delta V>V_{T2}$ and $V_1'=V_1-\Delta V>V_{ex}$. As a result, $B_1'$ is obtained from $EL_1$ and $B_2'$ is obtained from $EL_2$. For example, $B_1'=10$ ft-lambert and $B_2'=40$ ft-lambert resulting in a green color. If a larger switching increment $\Delta V_S$ were selected, the resulting light emission would be $B_1''$ and $B_2''$. For example, $B_1''=100$ ft-lambert $B_2''=55$ ft-lambert gives an orange-yellow color. Although there will be some intensity variation for different colors, the variation may be designed to be in the right direction for eye sensitivity, that is to have more intensity in the color range where the human eye is generally less sensitive to them.

The B-V hysteresis effect has been described hereinbefore for the orange EL emission ZnS:Mn. Similar effect is obtainable in other EL materials. Thus, other memory EL film may be used in place of ZnS:Mn. With ZnS:Mn memory EL, it is feasible to use ZnS:Cu, Mn (e.g., 1% Cu,0.02–0.05% Mn) (blue emission as shown in FIG. 3) in place of $EL_2$ (ZnS:Cu, Al green) such that a multicolor variation from blue, white, to orange may be achieved (FIG. 3). Alternatively ZnS:Mn, $TbF_S$ red EL is another choice.

In a more general arrangement for the practice of this invention three or more EL layers may be addressed in similar manner as described above to gain greater flexibility of color choice.

EMBODIMENTS OF THE INVENTION

A matrix addressed embodiment of this invention will be described with reference to FIG. 4. It comprises a transparent substrate, for example of glass, through which the ultimate display is perceived as by eye 13. A plurality of X direction addressed electrodes $X_1$, $X_2$. . . $X_n$ are established on substrate 12 and are also transparent and for example are of $SnO_2$ or thin metal film for example of aluminum. Deposited upon the X direction conductors is an insulator film comprised illustratively of barium-titanate, aluminum-oxide, yttrium-oxide or silicon nitride. There follows in the sandwich embodiment 10 the $EL_2$ layer, for example comprised of: ZnS:CuAl; or ZnS:Cu, Mn; or ZnS:Mn, $TbF_3$. Many phosphors similar to those registered with the Joint Electron Device Engineering Counsels and are published in Publication No. 16C dated Aug. 28, 1976 are suitable for use as the $EL_2$ film 18.

Another insulated layer 20 is established adjacent to $EL_2$ film 18 and comprises material similar to that identified above for insulator layer 16. A second electroluminescent film $EL_1$ is established adjacent to insulator layer 20 and has the hysteresis characteristic in its brightness versus voltage curves and is exemplified by the phosphor material ZnS:Mn. A reference concerning the hysteresis characteristic in the exemplary ZnS:Mn phosphor material is the article by Y. Yamauchi et al, IEEE, IEDM Digest, 1974, pp. 348–351.

Practice of this invention is not limited to use of said ZnS:Mn with memory effect. Other materials with comparable hysteresis effect characteristic are potentially available, as the physical mechanism from which the hysteresis effect stems is related to the polarization of electrons and holes within the material as consequence of input of energy. For example, as for the embodiment of FIG. 4, the energy results from an external electric field. For the embodiment illustrated by FIGS. 5A and 5B, a portion of the requisite electric field is applied externally and another portion thereof is derived from energy in the form of radiation, for example, laser beam or electron beam. There follows for the embodiment 10 another insulator layer 24 whose composition may be the same as that of insulator layers 16 and 20 noted hereinbefore. Then, the Y direction driver electrons $Y_1Y_2$. . . $Y_n$ are established on insulator layer 24 and are shown to number the same as the X direction driver electrodes. However, the numbers of said X-direction and Y-direction driver electrodes may be different dependent upon the area 1 configuration and dimensions of the desired display. The final layer of the sandwich structure of the embodiment 10 is insulator layer 28 which may or may not be transparent, and is preferably not transparent if there is not to be any viewing upon the side opposite to the eye point 13. Each cross-over point established by a respective pair of X-driver electrode and Y-driver electrode determines a light emission zone with the prescribed color characteristic in accordance with principles of this invention.

The structural elements which complete the embodiment 10 will now be described. The X driver electrodes also numbered 30-1, 30-2 . . . 30-n are connected to X-driver 32 which comprises all the requisite electronic equipment for establishing the spatial and temporal characteristics of the display as determined by the X1, X2, . . . Xn driver electrodes. The Y-driver electrodes are also numbered 34-1, 34-2, . . . 34-n and are connected to the Y-driver circuit 36 which comprises all the requisite electronic equipment for determining the character of the display as controlled by the Y-direction electrodes. Accordingly, through the established cooperation of the X-driver circuit 32 and Y-driver circuit 36, a multicolor display is produced by the embodiment 10 with variations in temporal and spatial characteristics as well as color characteristics. In accordance with the capabilities of the $EL_2$ layer 18 and $EL_1$ layer 22.

Figure 4:
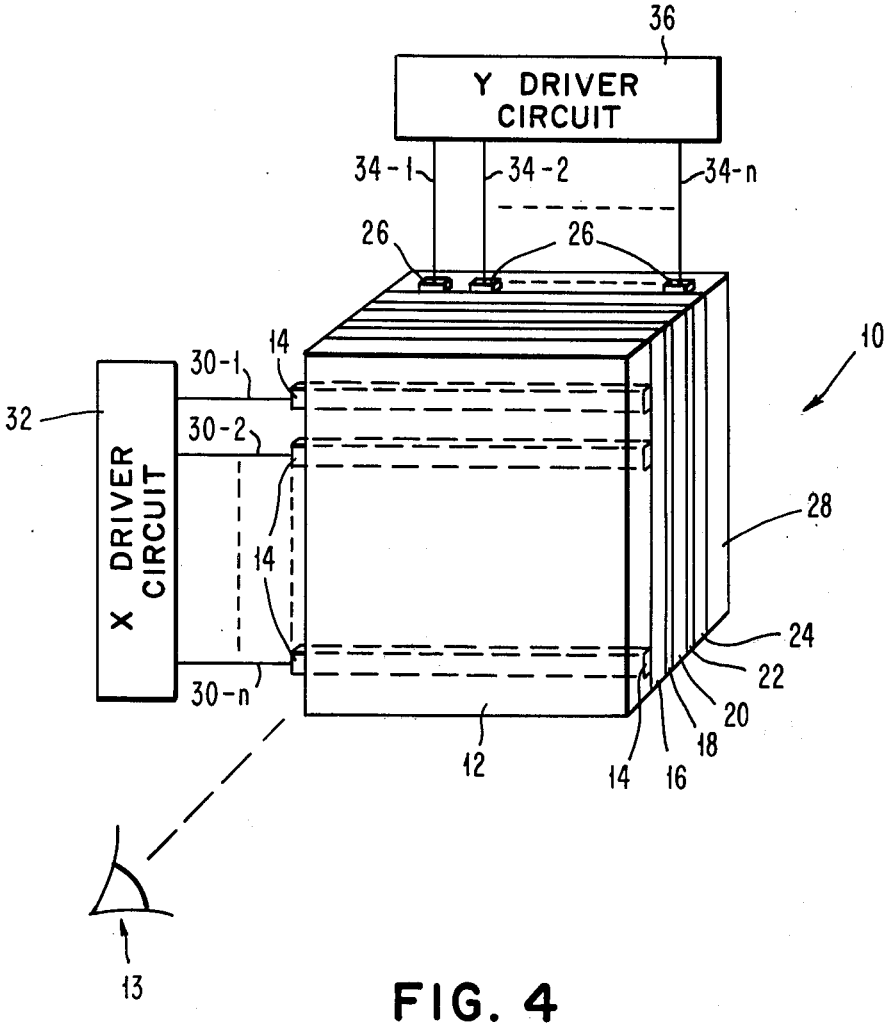
FIG. 4 is a schematic and perspective view of one embodiment of this invention wherein display is obtained by matrix addressing pairs of conductors from two orthogonal sets of conductors which activate respective zones of a layered structure incorporating two layers of different electroluminescent materials in accordance with the principles of this invention.

For the actual construction of the embodiment FIG. 10 illustrated in FIG. 4, the $EL_1$ layer 22 and the $EL_2$ layer 18 and the insulator layers 16, 20 and 24 may each be made either by evaporation or sputtering through conventional procedure. Copending and commonly assigned application Ser. No. 807,753 filed June 17, 1977 which provides descriptive information on construction of another electroluminescent panel, with one electroluminescent layer and on and off single color display, is incorporated herein by reference for the purpose of disclosure concerning fabrication technology.

Figure 5A:
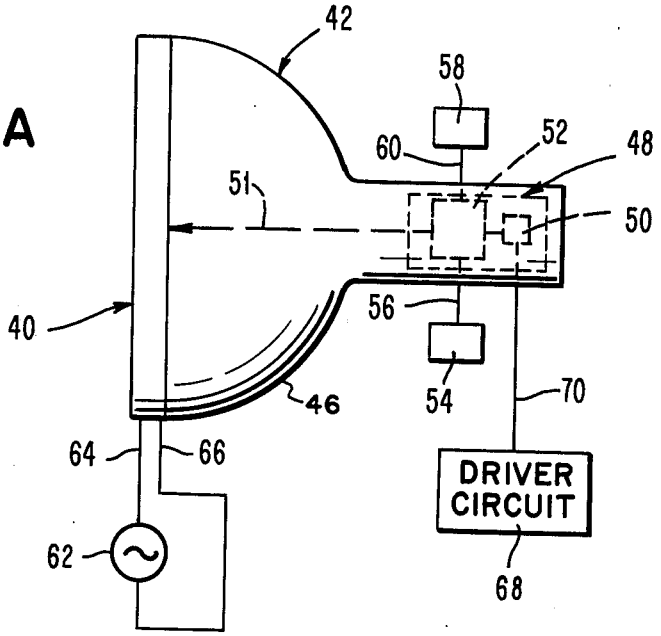
Figure 5B:
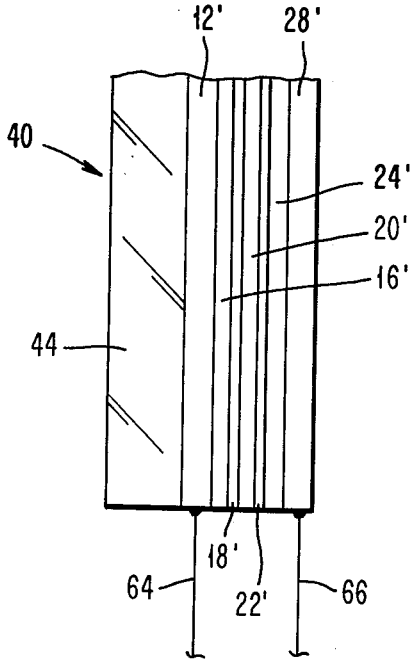

Another embodiment of this invention will be described with reference to FIGS. 5A and 5B wherein 5A illustrates the general characteristics of a beam tube for addressing an electroluminescent display in accordance with the principles of this invention by radiation, for example by electron beam or by laser beam; and FIG. 5B shows the structure of the electroluminescent sandwich 40 mounted for display purpose in the tube 42 of FIG. 5A. The structure 40 illustrated by FIG. 5B is similar to the display portion structure of the embodiment 10 of FIG. 4 except that the electrodes are continuous and there is additionally a front glass plate 44 for the tube 42 upon which the sandwich structure for providing the multicolor display in accordance with this invention is affixed. For convenience of description the comparable elements in FIG. 5B are indicated as primes to the same numbers given in FIG. 4. The structure of a display tube 42 shown in FIG. 5A except for the displaying portion 40 is conventional and will be described herein only generally.

The beam tube 42 comprises a housing 46 within there is structure 48 for providing the beam for addressing the display. The beam production portion 48 comprises a source 50 which in one form of the embodiment 42 provides an electron beam and in another form thereof provides a laser beam. The vacuum envelope 46 is not required in the laser beam addressed scheme. The beam 48 production portion comprises deflection means 52 which for an electron beam includes horozontal and vertical deflection electrodes or magnetic deflection means. Alternatively, for a laser beam, the deflection means 52 includes electric field actuated material which causes deflection of the laser beam. An X-direction deflection circuit 54 is connected by conductor 56 to beam deflection unit 52 and Y-direction deflection circuit 58 is connected by conductor 60 to deflection beam deflection unit 52. The operational requirements for the embodiment exemplified by FIG. 5A comprise an electrical circuit 62 which applies an alternating voltage to electroluminescent sandwich 40 via conductors 64 and 66. Beam driver circuit 68 is connected by conductor 70 to beam source 50.

What is claimed is:

1. A multicolor display device with memory, comprising:

a first memory electroluminescent layer of a first color electromagnetic emission, said first layer having a threshold voltage, an extinction voltage and a set of brightness-voltage hysteresis curves, a second electroluminescent layer of a second color electromagnetic emission proximate to said first layer, said second layer having a second threshold voltage and a steep brightness-voltage curve with saturation, means for switching said first layer to a relatively low impedance state for adjusting cooperatively the ratio of intensities of said first and second color emissions to obtain color variation characteristic with memory thereof from said display device, and means for applying an alternating voltage signal across said first and second layers to sustain said color variation characteristic.

2. Device as set forth in claim 1 wherein said device is matrix addressed by voltage.

3. Device as set forth in claim 1 wherein said means for switching said device is a beam.

4. Device as set forth in claim 3 wherein said beam is an electron beam.

5. Device as set forth in claim 4 wherein said beam is light beam.

6. Device as set forth in claim 5 wherein said light beam is a laser beam.

7. Device as set forth in claim 1 wherein said first layer is comprised of ZnS doped with Mn.

8. Device as set forth in claim 7 wherein said second layer is comprised of material from the group consisting of: ZnS:Cu, Al; ZnS:Cu, Mn; and ZnS:Mn, $TbF_3$.

9. Device as set forth in claim 1 wherein said alternating voltage consists of a sequence of pulses.

10. Device as set forth in claim 1 wherein said first and second layers are disposed in a sandwich structure comprised of a first electrode layer, a first insulator layer adjacent to said first electrode, said first electroluminescent layer being adjacent to said first insulator layer, a second insulator adjacent to said first electroluminescent layer, said second electroluminescent layer being adjacent to said second insulator layer, a third insulator layer adjacent to said second electroluminescent layer, and a second electrode layer adjacent to said third insulator layer, said means to apply said voltage being in electrical communication arrangement with said first and second electrodes.

11. Device as set forth in claim 10 wherein said first, second and third insulator layers are each comprised of material selected from the group consisting of barium-titanate, aluminum oxide, yttrium-oxide and silicon-nitride.

12. Device as set forth in claim 10 wherein said means to apply said voltage is directly connected to said electrodes.

13. Device as set forth in claim 1 wherein said means for switching applies at least one voltage pulse to said first layer.

* * * * *